US008075430B1

(12) United States Patent
Hester

(10) Patent No.: US 8,075,430 B1
(45) Date of Patent: Dec. 13, 2011

(54) ARROW TRANSMITTER

(76) Inventor: David D. Hester, Miami, FL (US)

( * ) Notice: Subject to any disclaimer, the term of this patent is extended or adjusted under 35 U.S.C. 154(b) by 115 days.

(21) Appl. No.: 12/721,292

(22) Filed: Mar. 10, 2010

(51) Int. Cl.
*F42B 6/04* (2006.01)

(52) U.S. Cl. ..... 473/578

(58) Field of Classification Search ..... 473/570, 473/578, 582, 583
See application file for complete search history.

(56) References Cited

U.S. PATENT DOCUMENTS

| | | | | |
|---|---|---|---|---|
| 3,790,948 | A | 2/1974 | Ratkovich | |
| 4,675,683 | A * | 6/1987 | Robinson et al. | 342/386 |
| 4,749,198 | A * | 6/1988 | Brailean | 473/570 |
| 4,885,800 | A * | 12/1989 | Ragle | 455/98 |
| 4,951,952 | A * | 8/1990 | Saddler | 473/570 |
| 4,976,442 | A | 12/1990 | Treadway | |
| 5,024,447 | A | 6/1991 | Jude | |
| 5,094,463 | A | 3/1992 | Dryden | |
| 5,134,552 | A * | 7/1992 | Call et al. | 362/203 |
| 5,141,229 | A * | 8/1992 | Roundy | 473/570 |
| 5,157,405 | A * | 10/1992 | Wycoff et al. | 342/386 |
| 5,188,373 | A | 2/1993 | Ferguson et al. | |
| 5,446,467 | A | 8/1995 | Willett | |
| 5,450,614 | A | 9/1995 | Rodriguez | |
| 6,612,947 | B2 | 9/2003 | Porter | |
| 6,856,250 | B2 | 2/2005 | Hilliard | |
| 7,232,389 | B2 | 6/2007 | Monteleone | |
| 7,300,367 | B1 | 11/2007 | Andol et al. | |
| 7,621,062 | B2 | 11/2009 | Cugliari | |
| 7,632,199 | B2 | 12/2009 | Kikos | |
| 2005/0231362 | A1 | 10/2005 | Pridmore et al. | |
| 2007/0142137 | A1 | 6/2007 | Davenhaver | |
| 2008/0287229 | A1 | 11/2008 | Donahoe | |

* cited by examiner

*Primary Examiner* — John Ricci
(74) *Attorney, Agent, or Firm* — Albert Bordas, P.A.

(57) ABSTRACT

An arrow transmitter comprises a head assembly having an arrow having a tip. Extending from the arrow is a shaft having a neck that terminates at a threaded portion. A tubular shaft assembly defines a first shaft cavity with a first exterior wall and first and second ends. The tubular shaft assembly also comprises fletching that is fixedly mounted onto the first exterior wall and a nock mounted onto the first end. A plugged housing assembly is housed within the tubular shaft assembly. A transmitter assembly is housed within the housing assembly. A global positioning system tracking unit determines a precise location of hunted game once struck and after the transmitter assembly is activated when a force overcomes the spring force of the spring member. Thus, causing the actuator pin to make contact with the first protrusion to activate the switch that activates the transmitter assembly.

17 Claims, 2 Drawing Sheets

ARROW TRANSMITTER

BACKGROUND OF THE INVENTION

1. Field of the Invention

The present invention relates to hunting equipment, and more particularly, to a hunting arrow having a transmitter located therein to locate game once struck.

2. Description of the Related Art

Hunting game with a bow and arrow is a popular and traditional sport in many parts of the world. However, one drawback when hunting in this manner is that after an arrow is shot, it is often difficult to locate, regardless of whether the game was struck or not. An arrow missing its target typically ends up in brush. If the arrow strikes the target game, such as a deer, the animal is often able to travel a long distance before it collapses as it succumbs to its wound. In such a case, it is often difficult to locate the wounded animal. In the first case, it is desirable to locate and recover the missing arrow, since modern hunting arrows can be relatively expensive. In the second case, it is desirable to locate the hunted game as well as recover the missing arrow.

Many systems for tracking arrows have been designed in the past. One of the difficulties associated with prior art arrows is limited battery life. Due to space and weight constraints, only very small, lightweight batteries can be used to power transmitters.

Applicant believes that one of the closest references corresponds to U.S. Pat. No. 5,446,467, issued on Aug. 29, 1995 to Willett for a tech-track. However, it differs from the present invention because Willett teaches a device that is detachable and when the arrow makes impact, the dart with the transmitter remains in the target.

Applicant believes that another reference corresponds to U.S. Pat. No. 6,612,947 issued to Porter on Sep. 2, 2003 for Radio Transmitter Assembly for Tracking an Arrow. However, it differs from the present invention because Porter teaches a radio transmitter assembly for use in tracking an arrow that employs an insert containing a radio transmitter that can inserted through the open end of an arrow and into the interior of the arrow shaft. After the insert has been secured within the arrow shaft, an arrowhead can be secured to a connector on the insert.

Applicant believes that another reference corresponds to U.S. Pat. No. 7,632,199 issued to Kikos on Dec. 15, 2009 for a hunting arrow tracking system. However, it differs from the present invention because Kikos teaches a locating and tracking system for tracking or locating an object of interest, such as a hunting arrow or wounded animal, that uses a transmitter in the arrow and a transceiver in combination with GPS positioning system for monitoring and relaying radio frequency signals from a battery powered microchip carried in the hunting arrow to provide a hunter with information as to the location of the arrow and/or to track the animal into which the arrow has been embedded during hunting.

Applicant believes that another reference corresponds to U.S. Pat. No. 7,300,367 issued to Andol, et al. on Nov. 27, 2007 for System for Tracking Wild Game. However, it differs from the present invention because Andol, et al. teaches an assembly for tracking an animal, which has been shot by an arrow. A shank portion of an arrow is received in a bushing, which in turn receives a housing for a transmitter. The housing is retained on the bushing during arrow flight by an elastomeric ring. Upon impact of the arrow with the animal, the elastomeric ring is dislodged, releasing the housing from the bushing. Associated with the housing are members, which penetrate the animal to attach the housing to the animal. A hand-held direction finding receiver receives signals from the transmitter so that direction to the animal is determined.

Applicant believes that another reference corresponds to U.S. Pat. No. 7,232,389 issued to Monteleone on Jun. 19, 2007 for a wounded animal tracker. However, it differs from the present invention because Monteleone teaches a device for locating a wounded animal for mounting on an arrow that has a head and a shaft. The device is mounted on the head adjacent the shaft. A collar with a circular cross section has a plurality of prongs preferably mounted equidistant about the collar. The prongs are located at an acute angle to the collar. A signaling unit is located in each prong. The prongs are perforated adjacent the collar so as to break off easily. Upon impact of the arrow, at least one of the prongs breaks off and sticks in the animal. A transmitting unit in the prong permits ready location of the wounded animal.

Applicant believes that another reference corresponds to U.S. Pat. No. 6,856,250 issued to Hilliard on Feb. 15, 2005 for a tracking system, apparatus and method. However, it differs from the present invention because Hilliard teaches a remotely locatable tracking device and system for use with a projectile that contacts a mobile target. The device is particularly useful with hunting arrows that contact a target animal. The device detaches from the arrow and attaches to the animal upon impact. The device is preferably comprised of a passive transponder and the system preferably uses a handheld transceiver to locate the transponder attached to the target animal.

Applicant believes that another reference corresponds to U.S. Pat. No. 7,621,062 issued to Cugliari on Nov. 24, 2009 for a bullet identification and tracking device. However, it differs from the present invention because Cugliari teaches an identification and tracking device for use in combination with a firearm bullet comprising a means for detaching the device from the bullet during penetration of the target. In this manner, the tracking device and/or identification device will be attached to an object when the bullet penetrates the object.

Applicant believes that another reference corresponds to U.S. Pat. No. 5,450,614 issued to Rodriguez on Sep. 12, 1995 for an arrow tracking apparatus. However, it differs from the present invention because Rodriguez teaches an arrow tracking apparatus that includes a radio transmitter assembly, attached to an arrow, for transmitting radio waves associated with the arrow. The radio transmitter assembly is in the form of a jacket that jackets a shaft of the arrow. A battery-powered hand-held receiver assembly is carried by a person for receiving radio waves from the radio transmitter assembly. The components of the radio transmitter assembly are distributed along the jacket, such that the arrow, equipped with the radio transmitter assembly, is well balanced so that the arrow does not wobble in its flight path. The jacket includes a substantially smooth surface, such that the arrow has both good dynamic flight characteristics and good aerodynamic characteristics. The radio transmitter assembly includes a transmitter unit and an antenna assembly, and the antenna assembly may include antennas in the form of barbs. The jacket includes a first jacket sub-unit and a second jacket sub-unit. The first jacket sub-unit and the second jacket sub-unit are adjustable with respect to each other along the shaft of the arrow such that optimal weight distribution along the shaft of the arrow can be achieved. The hand-held receiver assembly includes a handle portion and a directional antenna portion. The hand-held receiver assembly may include an output jack for headphones. The hand-held receiver assembly may also include a compass.

Applicant believes that another reference corresponds to U.S. Pat. No. 5,188,373 issued to Ferguson, et al. on Feb. 23, 1993 for a hunting arrow with signal generating means. However, it differs from the present invention because Ferguson, et al. teaches a hunting arrow especially adapted to release a transmitter into a quarry animal to enable location of the quarry after having been shot. The transmitter is secured to the hide of the quarry without substantial penetration into the animal. The device is particularly useful in the event that the hunting arrow passes completely through the quarry, or if imbedded therein is broken off or pulled out by the quarry. The arrow may be provided in two slidably engaged parts, with the transmitter releasably retained therein. An attachment device may be provided to remove the transmitter from the arrow and attach it to the quarry. Alternatively, the transmitter may be releasably secured to the outside of the arrow and released upon impact with the target animal.

Applicant believes that another reference corresponds to U.S. Pat. No. 5,094,463 issued to Dryden on Mar. 10, 1992 for a detachable arrow shaft insert. However, it differs from the present invention because Dryden teaches a detachable arrow shaft insert, battery housing and transmitter casing accommodating an arrowhead and allowing separation of the insert and thus transmitting means from the arrow shaft when the arrowhead is lodged in a target and an outward pulling force is applied to the arrow shaft. The arrow shaft insert has an insert body that fits within the arrow shaft. The insert body is secured with respect to the arrow shaft with O-rings, circumferential ribs, or longitudinal ribs. An electronic transmitter can be connected to one end of the insert body or battery housing such that the electronic transmitter is housed within the arrow shaft. A conventional arrowhead is attached to one end of the insert body. The arrowhead, insert body, battery housing and electronic transmitter, if used, will remain intact, lodged in an animal's body or target even if the arrow shaft is forcibly disengaged from the insert body.

Applicant believes that another reference corresponds to U.S. Pat. No. 5,024,447 issued to Jude on Jun. 18, 1991 for a transmitter in arrow. However, it differs from the present invention because Jude teaches an arrow incorporating a radio signal-transmitting device allows a hunter to find a lost arrow. The arrow includes a hollow aluminum shaft, which acts as the primary transmitting antenna. A braded metal cable inside the hollow shaft acts as a secondary antenna when the primary antenna is broken.

Applicant believes that another reference corresponds to U.S. Pat. No. 4,976,442 issued to Treadway on Dec. 11, 1990 for an arrow with removable transmitter and method of use. However, it differs from the present invention because Treadway teaches an arrow having a removable, battery-operated transmitter with an antenna, which transmitter is adapted to fit in a notch or slot provided in the arrow shaft, the transmitter further provided with a curved hook which terminates in a sharp hook tip having a barb. The hook tip and barb are designed to project through the slot or notch in the arrow shaft and engage and remain in the hide, bone or tissue of a deer or other game animal when the arrow strikes the animal, wherein the force of the strike causes the transmitter to exit the notch in the arrow shaft and remain in the animal, regardless of the arrow location. After the arrow strikes and penetrates the animal, whether the arrow breaks or travels completely through the animal, the transmitter remains in the animal and emits a radio signal capable of being received by a portable radio receiver, in order to track the game animal if a clean kill is not made. Alternatively, if the arrow misses the intended target, it may be located by the radio signal. A method of tracking a game animal by radio during archery hunting, which includes the steps of providing a notch or slot in the arrow shaft; inserting a battery-operated, hook-equipped radio transmitter in the notch or slot; impacting the arrow with the game animal to embed the hook in the game animal and remove the transmitter from the arrow shaft; and using a radio receiver which is tuned to the radio frequency of the transmitter for tracking the game animal.

Applicant believes that another reference corresponds to U.S. Pat. No. 3,790,948 issued to Ratkovich on Feb. 5, 1974 for a radio transmitting hunting arrow with finding means. However, it differs from the present invention because Ratkovich teaches a battery-powered radio transmitter is carried in the tip of a hunting arrow to aid in locating wounded game. The antenna for the transmitter is carried in the hollow shank of the arrow so that breakage of the shaft will not be detrimental to transmission of radio signals from the transmitter.

Applicant believes that another reference corresponds to U.S. Patent Application Publication No. 20050231362, published on Oct. 20, 2005 to Pridmore, Charles Franklin Jr. et al. for apparatus carrying a mounted RFID circuit for the purpose of deploying and generating a tracking signal (post shot only) from an arrow. However, it differs from the present invention because Pridmore et al. teach an invention that utilizes RFID Technology, plastic injection molded components, a flexible PCB, Micro batteries, active and passive electronic components and antenna wire to form an apparatus (Arrow mounted RFID Carrier) for the purpose of deploying and generating a tracking signal from an arrow mounted RFID Circuit. This device is mounted to the arrow shaft and is deployed upon impact with the target. During impact the Carrier assembly opens and separates from the arrow shaft and the antenna wire deploys to a given length, one end of the antenna wire penetrating the target and exiting the opposite side of the target while the trailing end remains exterior to the entry side of the broad head impact surface. Mean while, PCB Mounted components, IE Batteries, saline sensor, RFID Chip, etc, are activated by internal contact with body tissues and begin to emit a low level signal through the antenna wire which is then received by a hand held reader device. Distances of signal sensitivity are impacted by environmental conditions and life cycle of pulses can be limited, preferably to less than 24 hours by adjusting the power draw on the batteries.

Applicant believes that another reference corresponds to U.S. Patent Application Publication No. 20080287229, published on Nov. 20, 2008 to Donahoe; Robert V. for an apparatus, system and method for archery equipment. However, it differs from the present invention because Donahoe teaches an apparatus that is configured for inclusion in an arrow, where the apparatus includes a device configured to provide feedback to a user concerning the arrow shot from a bow, and a processor coupled to the device, the processor configured to control an operation of the device at least during a flight of the arrow.

Applicant believes that another reference corresponds to U.S. Patent Application Publication No. 20070142137, published on Jun. 21, 2007 to Davenhaver; Ricky L. for an electronic game tracking system. However, it differs from the present invention because Davenhaver teaches an aerodynamically designed miniature electronic radio transmitter that can be universally attached with the use of high tension rubber bands for use on any type of arrow shaft and with any type of broad-head design. The high-tension rubber bands allow the transmitter to be attached to any type of arrow design while offering minimal flight and trajectory disruptions while at the same time being releasable to attach to the animal upon impact regardless if the arrow passes through or remains embedded in the animal. Before the shot, a small magnet is removed from the solid-state transmitter to actuate the transmitter. The transmitter having two barbed hooks becomes embedded in the animal upon impact and remains with the animal. A handheld receiver with earphones attached is then swept in a manner to receive a regular audible interval pulsed signal that gains in strength as the hunters nears the downed game.

Other patents describing the closest subject matter provide for a number of more or less complicated features that fail to solve the problem in an efficient and economical way. None of these patents suggest the novel features of the present invention.

SUMMARY OF THE INVENTION

The present invention is an arrow transmitter, comprising a head assembly having an arrow having a tip. Extending from the arrow is a shaft having a neck that terminates at a threaded portion.

A tubular shaft assembly defines a first shaft cavity with a first exterior wall and first and second ends. The tubular shaft assembly also comprises fletching that is fixedly mounted onto the first exterior wall and a nock mounted onto the first end.

A housing assembly is housed within the tubular shaft assembly. The instant invention also has a plug.

A transmitter assembly is housed within the housing assembly. The transmitter assembly comprises a computer chip assembly, a switch, an actuator housing, and a battery assembly. The switch comprises a base and a first protrusion. The actuator housing comprises a sidewall, a stopper wall and a rear wall to house the first protrusion, a spring member, an actuator pin, and an actuator stopper. In a natural state, the actuator stopper is biased against the stopper wall due to a spring force of the spring member, whereby the spring member originates from the base.

A global positioning system tracking unit determines a precise location of hunted game once struck and after the transmitter assembly is activated when a force overcomes the spring force of the spring member. Thus, causing the actuator pin to make contact with the first protrusion to activate the switch that activates the transmitter assembly.

The plug comprises third and fourth ends. Extending from the third end is a second protrusion having antenna wire secured thereon. The second protrusion is shaped to receive a tool for applying torque thereon. The head assembly mounts onto the housing assembly, and the plug secures the transmitter assembly onto the housing assembly. The housing assembly comprises a second exterior wall with third and fourth ends. The third end comprises a ridge that is larger in diameter than the fourth end. Extending internally from third end is a second shaft cavity having a neck cavity that terminates at a threaded cavity. The second shaft cavity has a first cooperative shape and dimension to receive the shaft. The neck cavity has a second cooperative shape and dimension to receive the neck, and the threaded cavity has a third cooperative shape and dimension to receive the threaded portion.

Extending internally from the fourth end is a threaded section that terminates at a transmitter receiving cavity. The transmitter receiving cavity has a cooperative shape and dimension to receive the transmitter assembly, and the threaded section has yet another cooperative shape and dimension to receive the plug. The plug functions to keep the transmitter assembly snugly fitted within the transmitter receiving cavity.

The housing assembly further comprises peripheral channels. The battery assembly comprises at least one battery that makes contact with a contact point. Connected to the contact point are positive and negative leads that also connect to the switch and the computer chip assembly. An adhesive substance is applied onto the peripheral channels. The ridge is of a same diameter as the first exterior wall. A weight assembly has a same weight and exterior structural characteristics of a fully assembled housing assembly comprising the transmitter assembly and the plug.

Recorded location data can be stored within the global positioning system tracking unit, or transmitted to a central location data base, or internet-connected computer, using a cellular (GPRS), radio, or satellite modem embedded in the global positioning system tracking unit. This allows a hunted game's location to be displayed against a map backdrop either in real-time or when analyzing the track later, using customized software.

The required force is achieved when the head assembly comes to a sudden stop or loss of velocity, whereby momentum from the actuator pin overcomes the spring force of the spring member to cause the actuator pin to make contact with the first protrusion to activate the switch.

It is also possible to manually cause the actuator pin to again overcome the spring force of the spring member. This causes the actuator pin to again make contact with the first protrusion to de-activate the switch. Illuminating means may indicate when the switch is activated and/or de-activated.

It is therefore one of the main objects of the present invention to provide an arrow transmitter that locates an arrow that has been shot from a bow, whether it hits its target or not.

It is another object of this invention to provide an arrow transmitter that is readily attached to an arrow.

It is another object of this invention to provide an arrow transmitter that can be operated with a Global Positioning System (GPS) and/or radio waves.

It is another object of this invention to provide an arrow transmitter that is quickly and easily activated using an impact force of the arrow against a target, so that battery life is maximized.

It is another object of this invention to provide an arrow transmitter having a transmitter assembly that is replaceable and reparable.

It is another object of this invention to provide an arrow transmitter that is environmentally sensitive, whereby hunting arrows can be recovered after being shot.

It is another object of this invention to provide an arrow transmitter that is lightweight.

It is another object of this invention to provide a weight assembly to be used for practice instead of a transmitter assembly.

It is another object of this invention to provide an arrow transmitter that can be readily assembled and disassembled without the need of any special tools.

It is another object of this invention to provide an arrow transmitter, which is of a durable and reliable construction.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
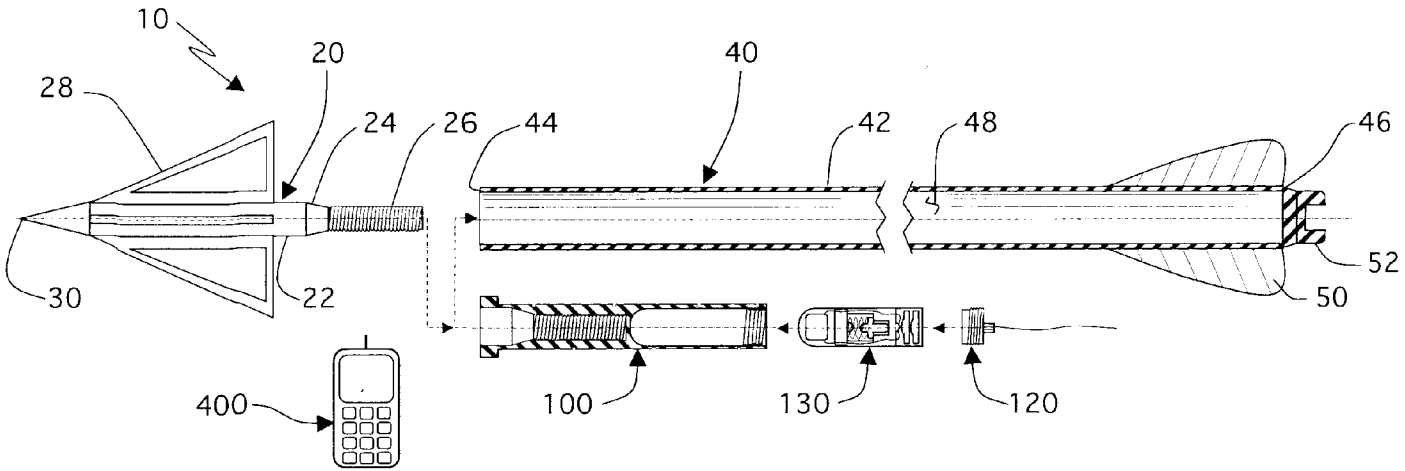
FIG. 1 is an exploded view of the instant invention, wherein a tubular shaft, housing, and transmitter assemblies have been cross-sectioned.

Referring now to the drawings, the present invention is generally referred to with numeral 10. It can be observed that it basically includes head assembly 20, tubular shaft assembly 40, housing assembly 100, plug 120, transmitter assembly 130, and Global Positioning System tracking unit 400.

As seen in FIG. 1, instant invention 10 is an arrow, and more specifically, a hunting arrow having transmitter assembly 130 located therein to locate game once struck. Game is defined as any wild animals, including birds and fishes, such as are hunted for food or taken for sport or profit. Head assembly 20 comprises arrow 28 having tip 30. Extending from arrow 28 is shaft 22 having neck 24 that terminates at threaded portion 26. Other arrows with various tips, sizes, and weights also having shaft 22, neck 24 and threaded portion 26 may alternatively be secured onto housing assembly 100. Tubular shaft assembly 40 defines shaft cavity 48 with exterior wall 42, and ends 44 and 46. Shaft cavity 48 has a cooperative shape and dimension to snugly receive housing assembly 100 therein through end 44. Tubular shaft assembly 40 also comprises fletching 50 that is fixedly mounted onto exterior wall 42 at, or adjacent to, end 46. Additionally, nock 52 is mounted onto end 46 to receive string of a bow, not seen. Transmitter assembly 130 is housed inside housing assembly 100, and kept in place with plug 120.

Figure 2:
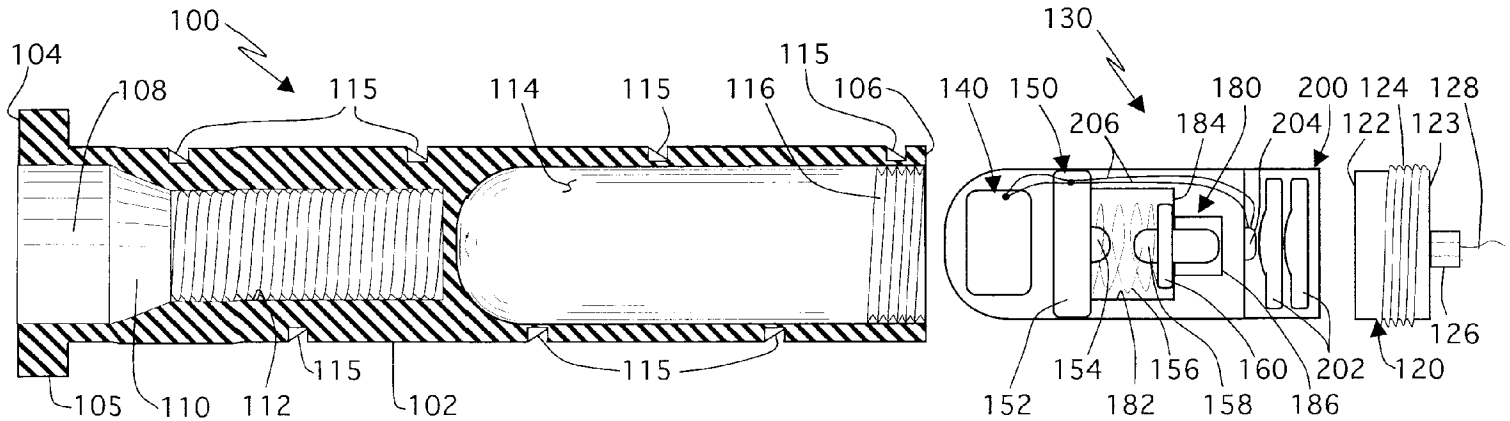
FIG. 2 is an enlarged view of the housing and transmitter assemblies seen in FIG. 1.

As best seen in FIG. 2, housing assembly 100 comprises exterior wall 102 with ends 104 and 106. End 104 comprises ridge 105, which is larger in diameter than end 106. Extending internally from end 104 is shaft cavity 108 having neck cavity 110 that terminates at threaded cavity 112. Shaft cavity 108 has a cooperative shape and dimension to receive shaft 22. Neck cavity 110 has a cooperative shape and dimension to receive neck 24, and threaded cavity 112 has a cooperative shape and dimension to receive threaded portion 26. Extending internally from end 106 is threaded section 116 that terminates at transmitter receiving cavity 114. Transmitter receiving cavity 114 has a cooperative shape and dimension to receive transmitter assembly 130. Threaded section 116 has a cooperative shape and dimension to receive plug 120, which functions to keep transmitter assembly 130 snugly fitted within transmitter receiving cavity 114. Furthermore, plug 120 also functions to keep the at least on battery 202 biased against contact point 204. Housing assembly 100 further comprises peripheral channels 115.

Transmitter assembly 130 comprises computer chip assembly 140, switch 150, actuator housing 180, and battery assembly 200. Switch 150 comprises base 152 and protrusion 154. Actuator housing 180 comprises sidewall 182, stopper wall 184 and rear wall 186 to house protrusion 154, spring member 156, actuator pin 158, and actuator stopper 160. In a natural state, actuator stopper 160 is biased against stopper wall 184 due to a spring force of spring member 156, whereby spring member 156 originates from base 152. Battery assembly 200 comprises at least one battery 202 that makes contact with contact point 204. Extending from contact point 204 are positive and negative leads 206 that also connect to switch 150 and computer chip assembly 140. Plug 120 comprises ends 122 and 123. Extending a predetermined distance from end 122 is threaded portion 124 that terminates at end 123. Extending from end 123 is protrusion 126 having antenna wire 128 secured thereon.

To assemble instant invention 10, transmitter assembly 130 is snugly fitted within transmitter receiving cavity 114 and secured with plug 120. It is noted that protrusion 126 may be shaped to receive a wrench to tool for applying torque if desired or required. Head assembly 20 is then secured onto housing assembly 100, whereby threaded portion 26 is screwed into threaded cavity 112. An adhesive substance, such as glue, may be brushed or otherwise placed into peripheral channels 115. Housing assembly 100 is then forced into tubular shaft assembly 40 through end 44 and into shaft cavity 48 until ridge 105 abuts end 44. In a preferred embodiment, the adhesive substance used on peripheral channels 115 is not a permanent adhesive. It is noted that ridge 105 is of a same diameter as exterior wall 42.

To disassemble instant invention 10, and specifically to remove housing assembly 100 from shaft cavity 48, head assembly 20 is unscrewed from threaded cavity 112. A tool or handle of cooperative dimensions, not seen, is screwed into threaded cavity 112. A rotational and pulling force is required to overcome an adhesive force from the adhesive substance to remove housing assembly 100 from shaft cavity 48. Disassembling is done for at least one battery 202 replacement, to perform maintenance, or for repair.

For practice shooting, weight assembly 300 replaces housing assembly 100. Weight assembly 300 has the same weight and exterior structural characteristics of fully assembled housing assembly 100 comprising transmitter assembly 130 and plug 120.

Figure 3:
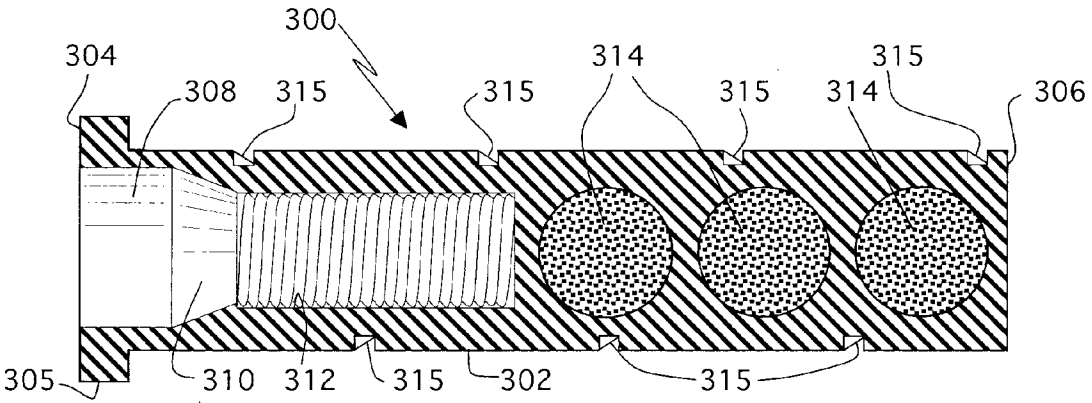
FIG. 3 is an enlarged cross-sectioned view of a weight assembly for use in the arrow for practice shooting.

As seen in FIG. 3, weight assembly 300 comprises exterior wall 302 with ends 304 and 306. End 304 comprises ridge 305, which is larger in diameter than end 306. Extending internally from end 304 is shaft cavity 308 having neck cavity 310 that terminates at threaded cavity 312. Shaft cavity 308 has a cooperative shape and dimension to receive shaft 22. Neck cavity 310 has a cooperative shape and dimension to receive neck 24, and threaded cavity 312 has a cooperative shape and dimension to receive threaded portion 26. Positioned internally from end 306 are weights 314. Weight assembly 300 further comprises peripheral channels 315. In addition, weight assembly 300 may be of a different color than housing assembly 100 for identification purposes.

To assemble instant invention 10 with weight assembly 300, head assembly 20 is secured onto weight assembly 300, whereby threaded portion 26 is screwed into threaded cavity 312. The adhesive substance is brushed or otherwise placed into peripheral channels 315. Weight assembly 300 is then forced into tubular shaft assembly 40 through end 44 and into shaft cavity 48 until ridge 305 abuts end 44. In a preferred embodiment, the adhesive substance used on peripheral channels 315 is not a permanent adhesive. It is noted that ridge 305 is also of a same diameter as exterior wall 42.

To disassemble instant invention 10, and specifically to remove weight assembly 300 from shaft cavity 48, head assembly 20 is unscrewed from threaded cavity 312. A tool or handle of cooperative dimensions, not seen, is screwed into threaded cavity 312. A rotational and pulling force is required to overcome an adhesive force from the adhesive substance to remove weight assembly 300 from shaft cavity 48.

Figure 4:
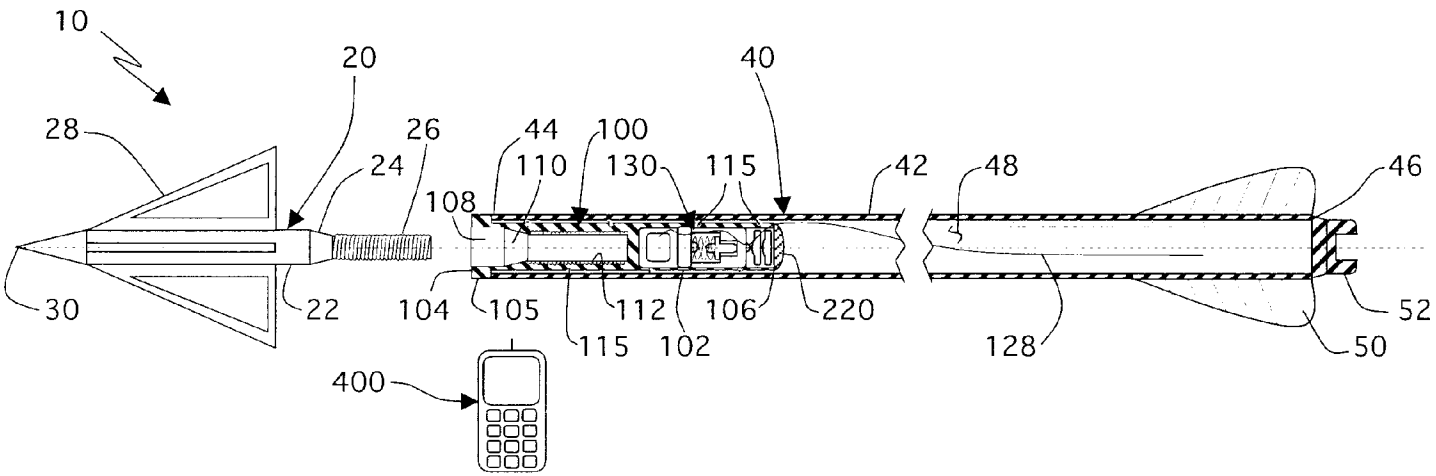
FIG. 4 is an exploded view of an alternated embodiment for the transmitter assembly, wherein the tubular shaft, housing, and transmitter assemblies have been cross-sectioned.

Seen in FIG. 4, is an alternate embodiment for housing assembly 100, wherein transmitter assembly 130 is permanently mounted therein and cap 220 securely closes end 106 of housing assembly 100. Cap 220 is removable to replace at least one battery 202 if required.

The Global Positioning System (GPS), is a U.S. space-based radio-navigation system that provides reliable positioning, navigation, and timing services to civilian users on a continuous worldwide basis. For anyone with a GPS receiver, the system will provide location and time. GPS provides accurate location and time information for an unlimited number of people in all weather, day and night, anywhere in the world. The GPS is made up of three parts: satellites orbiting the Earth; control and monitoring stations on Earth; and the GPS receivers owned by users. GPS satellites broadcast signals from space that are picked up and identified by GPS receivers. Each GPS receiver then provides three-dimensional location (latitude, longitude, and altitude) plus the time.

As seen in FIG. 4, equipped with Global Positioning System tracking unit 400, a hunter using the Global Positioning System can determine the precise location of the hunted game once struck with instant invention 10 comprising transmitter assembly 130 to record the position of the struck game at regular intervals. The recorded location data can be stored within Global Positioning System tracking unit 400, or it may be transmitted to a central location data base, or internet-connected computer, using a cellular (GPRS), radio, or satellite modem embedded in Global Positioning System tracking unit 400. This allows the hunted game's location to be displayed against a map backdrop either in real-time or when analyzing the track later, using customized software.

As stated above, while in a natural state actuator stopper 160 is biased against stopper wall 184 due to the spring force of spring member 156, whereby spring member 156 originates from base 152. In order to activate transmitter assembly 130, a necessary force is required to overcome the spring force of spring member 156 to cause actuator pin 158 to make contact with protrusion 154, thus activating switch 150. Such a necessary force is achieved when instant invention 10 comes to a sudden stop or loss of velocity after instant invention 10 is shot from a bow, not seen, whereby momentum from actuator pin 158 overcomes the spring force of spring member 156 to cause actuator pin 158 to make contact with protrusion 154, thus activating switch 150.

In the event that a hunter misses the intended target or game and activating switch 150 is unintentionally activated, the hunter may grasp instant invention 10 and jerk or tap it to cause momentum from actuator pin 158 to again overcome the spring force of spring member 156 and cause actuator pin 158 to make contact with protrusion 154, thus de-activating switch 150.

Although not illustrated, it is noted that instant invention 10 may comprise illuminating means, such as a light-emitting diode to indicate when switch 150 is activated and/or de-activated. As an example, the light-emitting diode may illuminate in "green" if switch 150 is activated and "red" if it's not.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An arrow transmitter, comprising:

A) a head assembly comprising an arrow having a tip, extending from said arrow is a shaft having a neck that terminates at a threaded portion;

B) a tubular shaft assembly defining a first shaft cavity with a first exterior wall and first and second ends, said tubular shaft assembly also comprises fletching that is fixedly mounted onto said first exterior wall and a nock mounted onto said first end;

C) a housing assembly housed within said tubular shaft assembly;

D) a plug;

E) a transmitter assembly housed within said housing assembly, said transmitter assembly comprises a computer chip assembly, a switch, an actuator housing, and a battery assembly, said switch comprises a base and a first protrusion, and said actuator housing comprises a sidewall, a stopper wall and a rear wall to house said first protrusion, a spring member, an actuator pin, and an actuator stopper, in a natural state, said actuator stopper is biased against said stopper wall due to a spring force of said spring member, whereby said spring member originates from said base; and F) a global positioning system tracking unit to determine a precise location of hunted game once struck and after said transmitter assembly is activated when a force overcomes said spring force of said spring member to cause said actuator pin to make contact with said first protrusion to activate said switch that activates said transmitter assembly.

2. The arrow transmitter set forth in claim 1, further characterized in that said plug comprises third and fourth ends, extending from said third end is a second protrusion having antenna wire secured thereon.

3. The arrow transmitter set forth in claim 2, further characterized in that said second protrusion is shaped to receive a tool for applying torque thereon.

4. The arrow transmitter set forth in claim 1, further characterized in that said head assembly mounts onto said housing assembly, and said plug secures said transmitter assembly onto said housing assembly.

5. The arrow transmitter set forth in claim 1, further characterized in that said housing assembly comprises a second exterior wall with third and fourth ends, said third end comprises a ridge that is larger in diameter than said fourth end, extending internally from third end is a second shaft cavity having a neck cavity that terminates at a threaded cavity.

6. The arrow transmitter set forth in claim 5, further characterized in that said second shaft cavity has a first cooperative shape and dimension to receive said shaft, said neck cavity has a second cooperative shape and dimension to receive said neck, and said threaded cavity has a third cooperative shape and dimension to receive said threaded portion.

7. The arrow transmitter set forth in claim 5, further characterized in that extending internally from said fourth end is a threaded section that terminates at a transmitter receiving cavity, said transmitter receiving cavity has a first cooperative shape and dimension to receive said transmitter assembly, and said threaded section has a second cooperative shape and dimension to receive said plug, said plug functions to keep said transmitter assembly snugly fitted within said transmitter receiving cavity.

8. The arrow transmitter set forth in claim 5, further characterized in that said ridge is of a same diameter as said first exterior wall.

9. The arrow transmitter set forth in claim 1, further characterized in that said housing assembly further comprises peripheral channels.

10. The arrow transmitter set forth in claim 9, further characterized in that an adhesive substance is applied onto said peripheral channels.

11. The arrow transmitter set forth in claim 1, further characterized in that said battery assembly comprises at least one battery that makes contact with a contact point.

12. The arrow transmitter set forth in claim 11, further characterized in that connected to said contact point are positive and negative leads that also connect to said switch and said computer chip assembly.

13. The arrow transmitter set forth in claim 1, further comprising a weight assembly having a same weight and exterior structural characteristics of a fully assembled said housing assembly comprising said transmitter assembly and said plug.

14. The arrow transmitter set forth in claim 1, further characterized in that recorded location data can be stored within said global positioning system tracking unit, or transmitted to a central location data base, or internet-connected computer, using a cellular (GPRS), radio, or satellite modem embedded in said global positioning system tracking unit to allow a hunted game's location to be displayed against a map backdrop either in real-time or when analyzing the track later, using customized software.

15. The arrow transmitter set forth in claim 1, further characterized in that said force is achieved when said head assembly comes to a sudden stop or loss of velocity, whereby momentum from said actuator pin overcomes said spring force of said spring member to cause said actuator pin to make contact with said first protrusion to activate said switch.

16. The arrow transmitter set forth in claim 15, further characterized in that manually causing said actuator pin to again overcome said spring force of said spring member causes said actuator pin to again make contact with said first protrusion to de-activate said switch.

17. The arrow transmitter set forth in claim 1, further comprising illuminating means to indicate when said switch is activated and/or de-activated.

* * * * *